US005564945A

United States Patent [19]

Domingos et al.

[11] Patent Number: 5,564,945

[45] Date of Patent: Oct. 15, 1996

[54] ONE-PIECE CONDUCTIVE CONNECTOR SHELL AND METHOD FOR MAKING THE SAME

[75] Inventors: José A. T. Domingos, Reading; William T. Parker, Boiling Springs, both of Pa.; Shawn W. Burkholder, Roanoke, Va.

[73] Assignee: The Whitaker Corporation, Wilmington, Del.

[21] Appl. No.: 283,130

[22] Filed: Jul. 29, 1994

[51] Int. Cl.[6] ..... H01R 13/73

[52] U.S. Cl. ..... 439/567; 439/607

[58] Field of Search ..... 439/95, 108, 567, 439/570, 569, 607, 609, 571, 572

[56] References Cited

U.S. PATENT DOCUMENTS

| | | | |
|---|---|---|---|
| 4,034,471 | 7/1977 | Bias | 29/629 |
| 4,512,618 | 4/1985 | Kumar | 439/95 |
| 4,911,659 | 3/1990 | Viselli | 439/570 |
| 4,938,704 | 7/1990 | Fujiura | 439/95 |
| 4,943,244 | 7/1990 | Teck et al. | 439/567 |
| 5,104,326 | 4/1992 | Smith et al. | 439/95 |
| 5,158,481 | 10/1992 | Frantz | 439/607 |

FOREIGN PATENT DOCUMENTS

| | | |
|---|---|---|
| 0180284 | 5/1986 | European Pat. Off. . |
| 0180284A2 | 7/1986 | European Pat. Off. . |
| 2265768 | 10/1993 | United Kingdom . |
| WO88/08627 | 11/1988 | WIPO . |

*Primary Examiner*—Gary F. Paumen
*Attorney, Agent, or Firm*—Anton P. Ness

[57] ABSTRACT

A one-piece conductive connector shell (1) for use in an electrical connector comprises a substantially planar flange (5) that is peripherally disposed about an annular, D-shaped projection (10). The annular D-shaped projection (10) extends out of the plane defined by the flange (5). Two fastening wings (15) are laterally disposed on the flange (15) in spaced-apart relation to one another. Each of the two fastening wings (15) comprise a pair of upper latching tabs (30) and a pair of lower grounding tabs (40). The upper latching tabs (30) and the lower grounding tabs (40) are adapted to be fixedly assembled to an insulating connector housing (100). The pair of lower grounding tabs (40) are further adapted to electrically and mechanically connect the one-piece conductive connector shell (1) to a printed circuit board. A pair of jackscrew mounting apertures (60) are disposed on each fastening wing (15), between the upper latching tabs (30) and the lower grounding tabs (40). The jackscrew mounting apertures (60) comprise a pair of tubular projections (62) that are formed so as to bulge out of the plane defined by the fastening wings (15). The tubular projections (62) include a plurality of cold-formed internal threads that are adapted to accept a mating jackscrew.

4 Claims, 7 Drawing Sheets

ONE-PIECE CONDUCTIVE CONNECTOR SHELL AND METHOD FOR MAKING THE SAME

FIELD OF THE INVENTION

The present invention relates to a shielded electrical connector that is adapted to be mounted on a printed circuit board, and more particularly to a new and improved right angle shielded connector having a one-piece conductive connector shell.

BACKGROUND OF THE INVENTION

A one-piece printed circuit board connector shell is disclosed in European Patent Application No. 85201751.6. This connector shell is designed to provide electromagnetic interference/electrostatic discharge (EMI/ESD) shielding and a pathway to ground potential in a D-type right angle connector. This prior art connector shell comprises an annular D-shaped nose portion extending outwardly from a planar flange portion. A pair of laterally spaced printed circuit board (PCB) mounting tabs comprise grounding straps that extend rearwardly from the flange. Retaining latches extend downward from the ends of the grounding straps and are adapted to be secured to a printed circuit board. Integral spring fingers are disposed on lateral side portions of the annular D-shaped nose portion for engaging a corresponding D-shaped nose portion of an insulating connector housing.

A pair of jackscrew receiving apertures are located within the planar flange. These jackscrew receiving apertures consist of tapped (threaded) holes in the planar flange that are positioned on the lateral sides of the D-shaped nose portion. They are typically used in this and other prior art connector shell designs as a substitute for loose-piece, internally-threaded sleeve inserts.

In the prior art, threaded sleeve inserts have often been replaced by threaded flange holes in order to reduce the high manufacturing cost associated with loose-piece assembly. Unfortunately, threaded flange holes have also proven to be a limiting aspect of these prior art designs. In particular, they have been found to be prone to stripping when mated to threaded jackscrews. The tendency of threaded flange holes to strip during mating has often resulted in failure of the connector in the field. As a result, flange holes having threads extending through the thickness of the flange have not been cost effective when compared to separately assembled, internally-threaded sleeve inserts.

SUMMARY OF THE INVENTION

The present invention was developed to provide a one-piece conductive connector shell having a lower manufacturing cost and a higher reliability in the field.

According to a feature of the invention, a jackscrew mounting aperture is provided as an integral component of a one-piece conductive connector shell. The jackscrew mounting aperture comprises a tubular projection that bulges out of the plane of the flange. The tubular projection further includes a plurality of cold-formed internal threads adapted to accept a correspondingly threaded jackscrew.

A further feature of the invention resides in a one-piece conductive connector shell having latching features for fixedly engaging an insulating connector housing.

Another feature of the present invention resides in a one-piece conductive connector shell that also provides grounding straps and integral boardlocks for electrically and mechanically interconnecting the one-piece conductive connector shell to a printed circuit board.

An advantage of the invention resides in a one-piece conductive connector shell having internally threaded jackscrew mounting apertures that are formed in the shell during a single manufacturing process.

Another advantage of the invention resides in a one-piece conductive connector shell that provides EMI/ESD and radio frequency interference (RFI) shielding for a printed circuit board mounted connector.

According to the present invention, a one-piece conductive connector shell is provided for an electrical connector. The one-piece conductive connector shell comprises a substantially planar flange that is peripherally disposed about an annular D-shaped projection. The annular D-shaped projection extends out of the plane defined by the flange. Two fastening wings are laterally disposed on the flange in spaced-apart relation to one another. The two fastening wings are positioned so as to be adjacent to the lateral sides of the D-shaped projection. Each of the two fastening wings comprises an upper latching tab and a lower grounding tab. The upper latching tabs and the lower grounding tabs are adapted to fixedly engage an insulating connector housing so as to form a complete connector assembly. The lower grounding tabs are further adapted to electrically and mechanically connect the one-piece conductive connector shell to a printed circuit board. In particular, an integral boardlock is disposed at the end of each lower grounding tab to both mechanically and electrically fasten the one-piece conductive connector shell to the printed circuit board.

A jackscrew mounting aperture is disposed on each fastening wing, between the upper latching tab and the lower grounding tab. Each of the jackscrew mounting apertures comprises a tubular projection that is formed so as to bulge out of the plane defined by the fastening wings and the flange, and to project rearwardly therefrom. Each of the tubular projections includes a plurality of cold-formed internal threads that are adapted to accept a mating jackscrew.

A preferred embodiment of the invention will now be described by way of example, with reference being made to the accompanying drawings wherein like numerals refer to like parts and further wherein:

DETAILED DESCRIPTION OF THE PREFERRED EMBODIMENT

Figure 1:
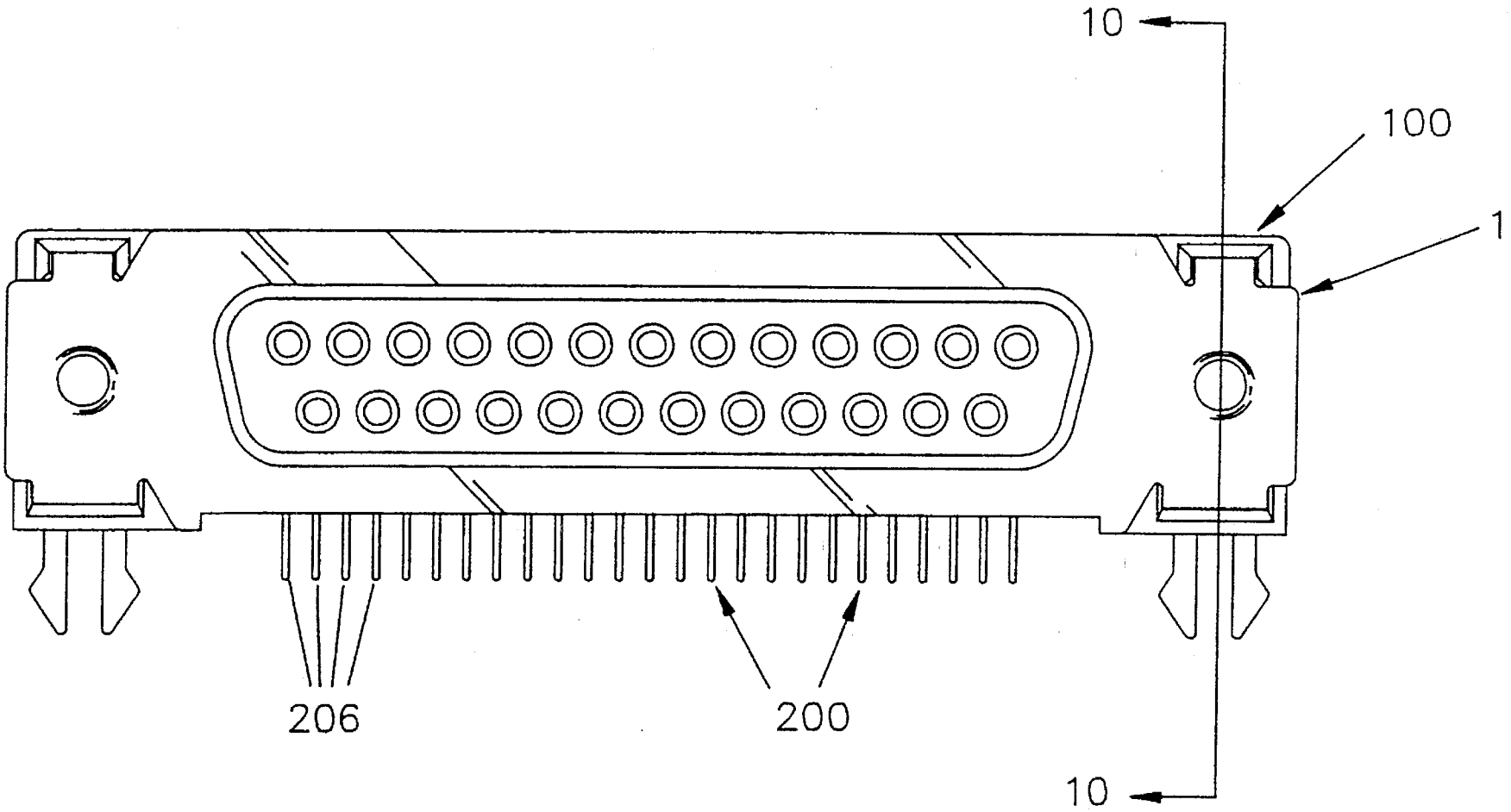
FIG. 1 is a front plan view, in elevation, of the one-piece conductive connector shell assembled to an insulating connector housing.
Figure 2:
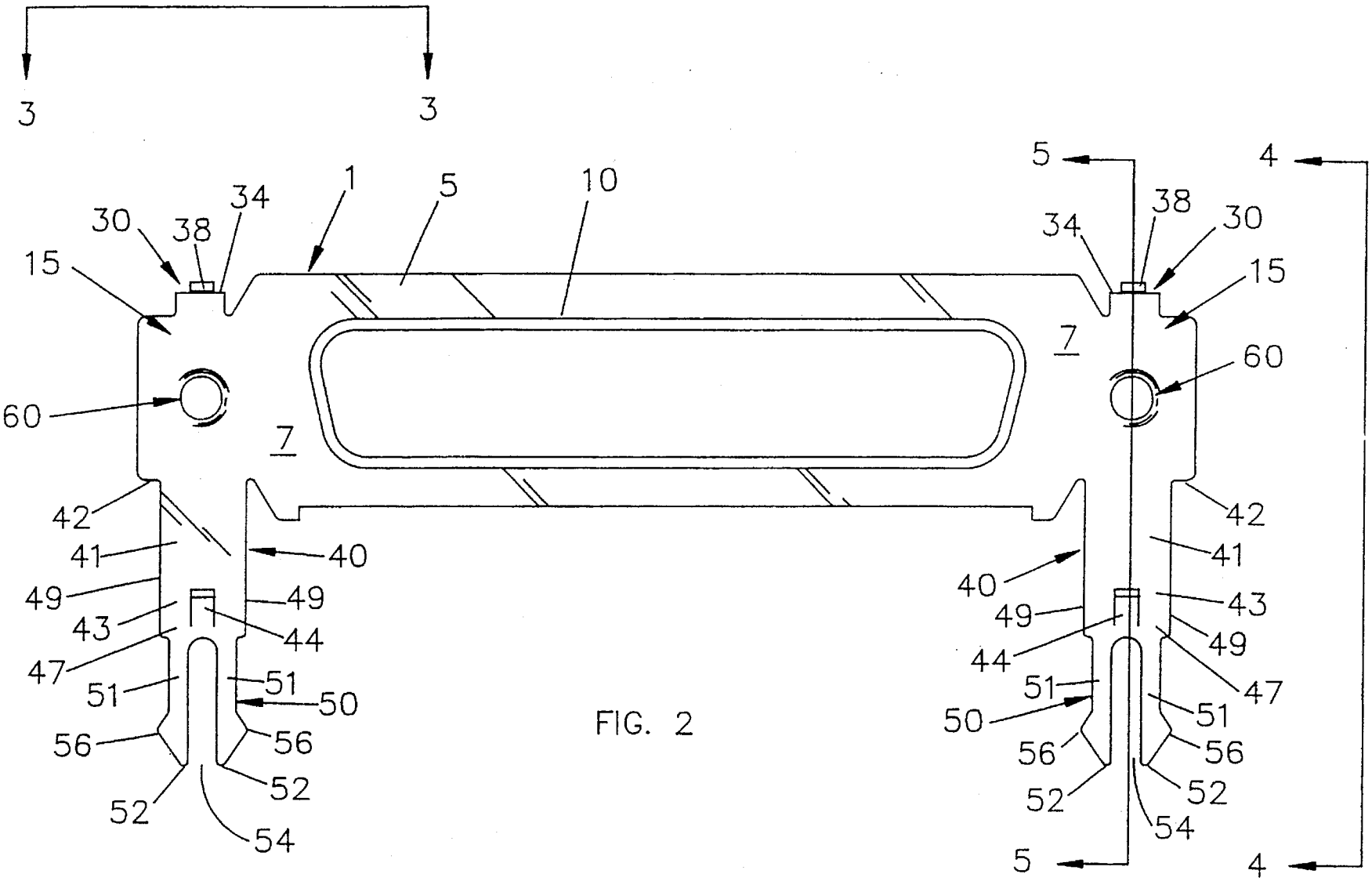
FIG. 2 is a front plan view, in elevation, of the one-piece conductive connector shell of the present invention.

Referring first to FIGS. 1 and 2, the preferred embodiment of the present invention comprises a stamped and formed one-piece conductive connector shell 1 that is adapted to be assembled to an insulating connector housing 100 having electrical contacts 200 disposed therein. The one-piece conductive connector shell 1 generally comprises a flange 5 (FIG. 2), an annular D-shaped projection 10, and a pair of fastening wings 15.

Figure 3:
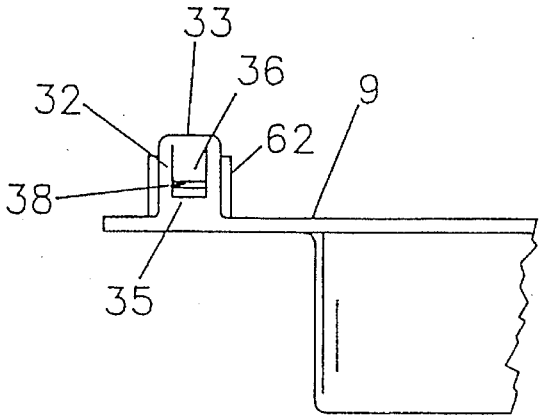
FIG. 3 is a top plan view, partially broken away, of the one-piece conductive connector shell showing an upper latching tab.
Figure 4:
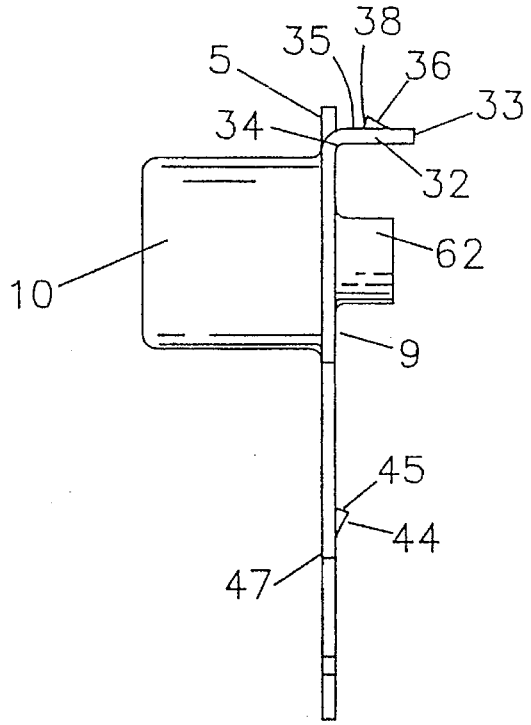
FIG. 4 is a side view of the one-piece conductive connector shell, as taken along line 4—4 of FIG. 2, showing an upper latching tab, a tubular projection, and a lower grounding tab.

More particularly, flange 5 is substantially planar and includes a front surface 7 and a back surface 9 (FIG. 3). Flange 5 is shaped so as to fully shield a corresponding flange on the insulating connector housing 100, as will hereinafter be disclosed in further detail. The annular D-shaped projection 10 extends out of the plane defined by flange 5 (FIG. 4). D-shaped projection 10 is adapted to receive the insulating connector housing 100, as will hereinafter be disclosed in further detail.

Two substantially identical fastening wings 15 are disposed in spaced-apart relation on the lateral sides of flange 5, so as to be adjacent to the lateral sides of D-shaped projection 10 (FIG. 2). Fastening wings 15 are substantially coplanar with flange 5 (FIGS. 2, 3, and 4). Flange 5 is cut back at its top and bottom edges, adjacent to and inboard of fastening wings 15, so as to further define the upper and lower portions of the fastening wings. Fastening wings 15 are adapted to (i) secure one-piece conductive connector shell 1 to the insulating connector housing 100, (ii) electrically fasten one-piece conductive connector shell 1 to a PCB, and (iii) receive mating jackscrews.

More particularly, and now referring to FIGS. 2, 3, and 4, each of the fastening wings 15 comprises an upper latching tab 30, a lower grounding tab 40, and a jackscrew mounting aperture 60.

Each upper latching tab 30 comprises a projection 32 (FIGS. 3 and 4). Projections 32 extend rearwardly at a 90 degree angle with respect to fastening wings 15, and terminate in a free end 33. Projections 32 also include a central portion 35 that is cut out to define an upper retaining latch 36. Upper retaining latch 36 is cantilevered so as to have a forwardly facing free end 38. Upper retaining latch 36 is adapted to be bent upwards out of the plane defined by projection 32 so as to be able to engage a corresponding internal shoulder of a cavity in insulating connector housing 100, as will hereinafter be disclosed in further detail.

Figure 5:
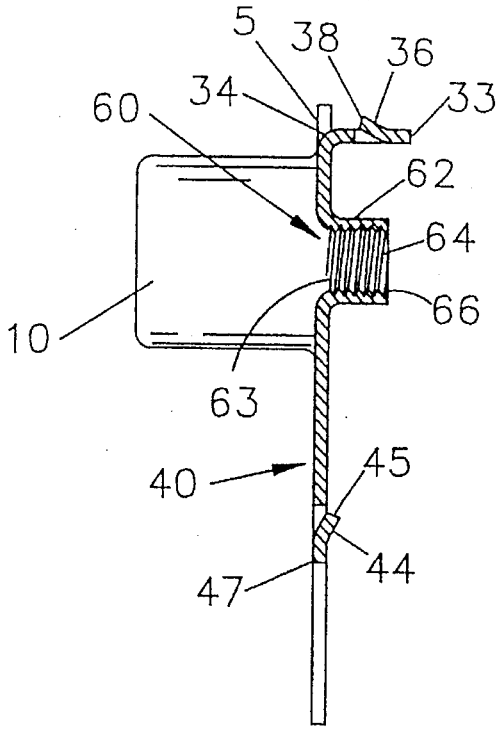
FIG. 5 is a cross-sectional view, as taken along line 5—5 of FIG. 2.

Still referring to FIGS. 2, 3, and 4, each lower grounding tab 40 comprises a projection 41 (FIG. 2) extending downwardly from a lower edge 42 of each fastening wing 15. Projection 41 comprises a central or intermediate portion 43 that is cut out to define a lower retaining latch 44. Lower retaining latch 44 is essentially identical to upper retaining latch 36 disclosed in detail above. More particularly, lower retaining latch 44 is cantilevered so as to have a free end 45 (FIGS. 4 and 5). Lower retaining latch 44 is adapted to be bent out of the plane defined by projection 41 so as to be able to engage a corresponding internal shoulder of a cavity in insulating connector housing 100, as will hereinafter be disclosed in further detail. Lower retaining latch 44 is located adjacent to distal end 47 of projection 41 (FIG. 2).

Integral boardlocks 50 are disposed at the distal end 47 of each projection 41. Integral boardlocks 50 electrically and mechanically fasten lower grounding tabs 40 to a PCB. They provide an electrical pathway between one-piece conductive connector shell 1 and the electrical traces on the PCB. Integral boardlocks 50 comprise a pair of flexible, elongate tines 51 extending downwardly in spaced-apart relation from the distal end 47 of each projection 41. A slot 54 is defined between tines 51. Tines 51 are spaced inwardly from lateral edges 49 of projection 41. Tines 51 include tip portions 52 at their distal ends. Integral boardlocks 50 further include synclinal ramp surfaces 56 disposed on their outside edges adjacent to tip portions 52. Synclinal ramp surfaces 56 are adapted to mechanically fasten lower grounding tabs 40 to holes in a PCB.

Now referring to FIGS. 2, 4, and 5, a pair of jackscrew mounting apertures 60 are laterally disposed adjacent to D-shaped projection 10, between upper latching tabs 30 and lower grounding tabs 40. Each jackscrew mounting aperture 60 comprises a tubular projection 62 that is formed in-situ during stamping, so as to project rearwardly out of the plane defined by each fastening wing 15. Tubular projections 62 include a plurality of internal threads 64 (FIG. 5). Internal threads 64 are cold-formed in interior surface 66 during the stamping and forming of one-piece conductive connector shell 1.

More particularly, one-piece conductive connector shell 1 is typically manufactured in a conventional high-speed stamping press, using a conventional die tool, both of which are well known in the art. To stamp and form a one-piece conductive connector shell according to the present invention, a flat strip of conductive metal, such as a cold rolled steel or the like, is progressively fed into a conventional stamping die tool. Flange 5, D-shaped projection 10, and fastening wings 15 are progressively profiled and formed in the metal strip by a plurality of stations located in the die tool.

The tubular projections 62 are formed in the metal strip as follows. A pair of piercing punch tools pierce the metal strip at the point on each fastening wing 15 where a tubular projection 62 is to be formed. Once a hole is formed in the strip, a punching tool in a subsequent station in the die is forced against the peripheral edges of the pierced hole so as to draw the peripheral edges downwardly, out of the plane of the metal strip. Typically, the punching tool has a diameter somewhat larger than the diameter of the pierced hole. The action of the punch against the peripheral edges of the pierced hole causes the surrounding material to bulge out of the plane defined by fastening wing 15, thus forming each tubular projection 62. Each tubular projection 62 has a central lumen 63 (FIG. 5) that is formed as the punch draws the surrounding material into the pierced hole.

Once tubular projection 62 is formed, a tapping head station inserts a rotatable, cold-forming tap into central lumen 63 of tubular projection 62. The tapping head station is internally positioned within the die tool and has a geared transmission mechanism that is adapted to hold and rotate the cold-forming tap.

More particularly, the geared transmission is adapted to rotate the cold-forming tap in a first direction on a downward stroke of the press and in a second direction on an upward stroke of the press. The rotating cold-forming tap enters the tubular projection's central lumen 63 on a downward stroke of the stamping press. As the cold-forming tap enters central lumen 63, it displaces the metal comprising interior surface 66 without removing it. The rolling action of the tap threads against interior surface 66 of central lumen 63 causes a plurality of internal threads 64 to be formed in the metal. Advantageously, internal threads 64 are formed without removing any metal from tubular projection 62. Thus, a plurality of cold-formed internal threads 64 (FIG. 5) are rolled into interior surface 66 of tubular projection 62 during each stroke of the stamping press. It has been found that the tapping head manufactured by the Adwin Corporation is particularly well suited for this process.

Now referring to FIGS. 1, 6, 7, and 8, one-piece conductive connector shell 1 is intended to be used in conjunction with the insulating connector housing 100 so as to form a complete electrical connector. More particularly, insulating connector housing 100 comprises a flange 120, a base portion 140, a D-shaped projection 160, a plurality of mutually-insulated cavities 180 (FIG. 7), and a hood portion 190.

Figure 6:
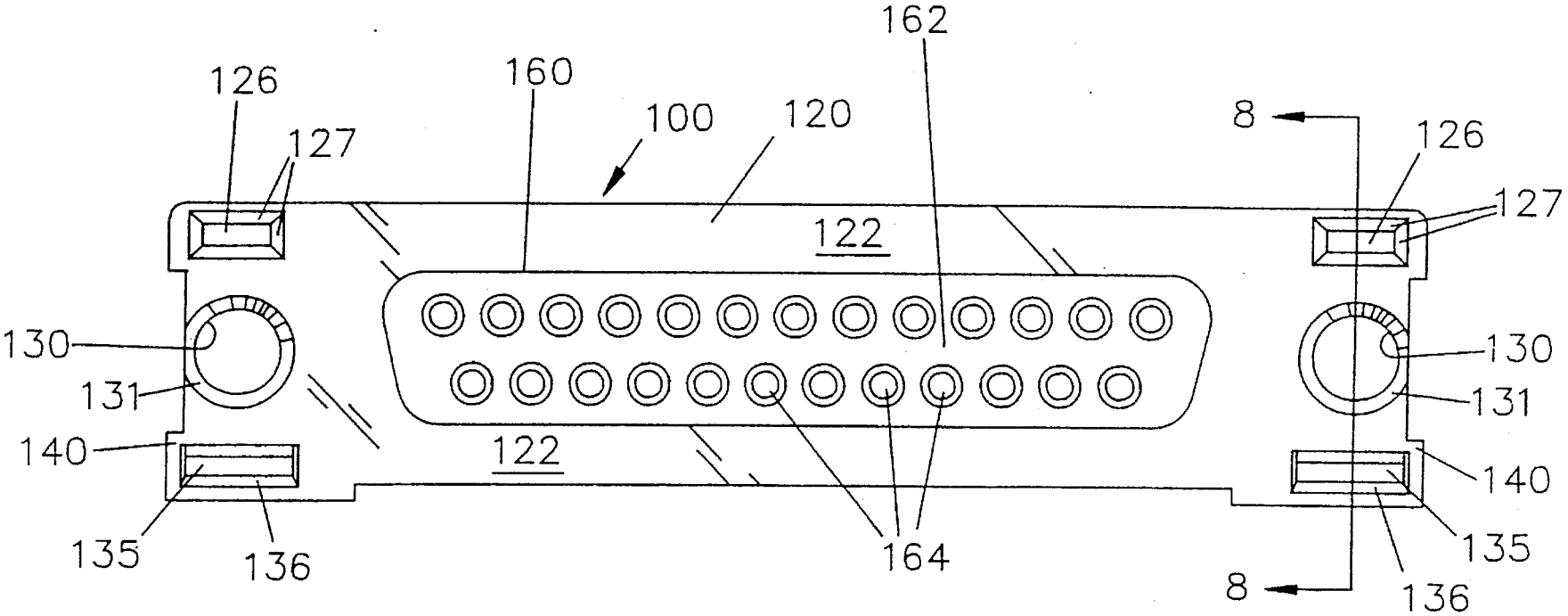
FIG. 6 is a front plan view, in elevation, of an insulating connector housing adapted for assembly to the one-piece conductive connector shell of the present invention.
Figure 7:
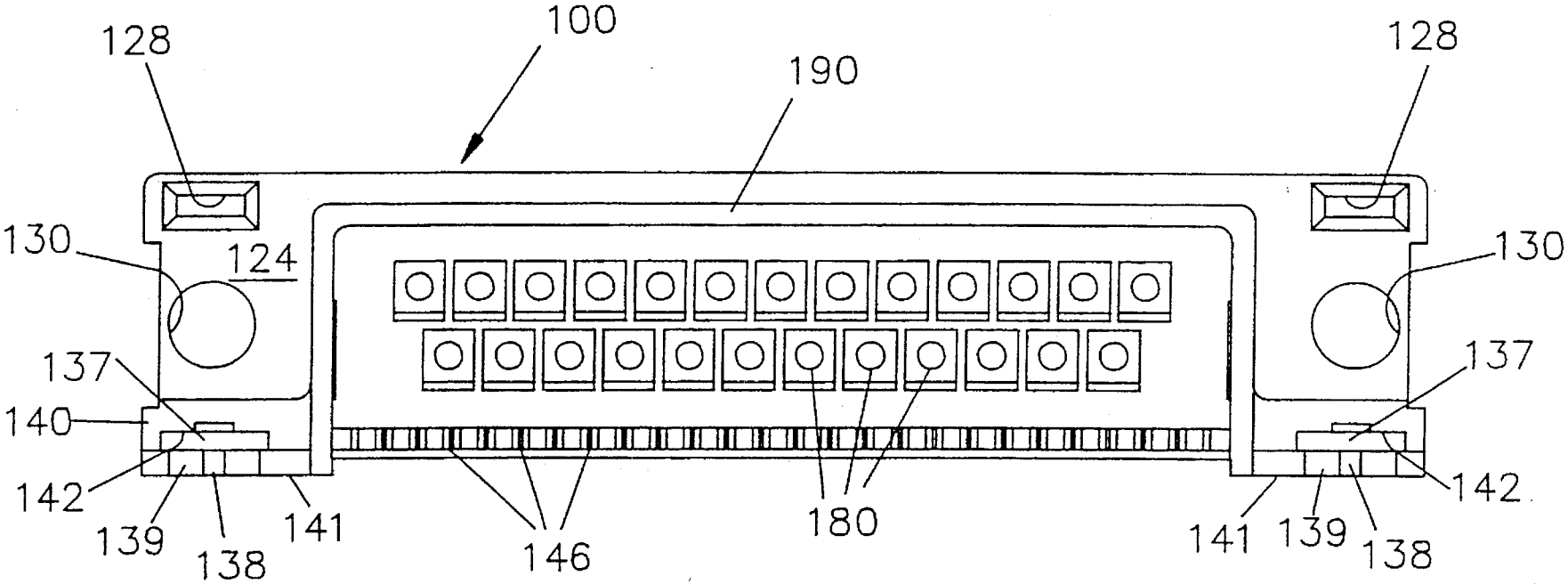
FIG. 7 is a rear plan view, in elevation, of the insulating connector housing of FIG. 6.

Flange 120 comprises a front surface 122 (FIG. 6) and a back surface 124 (FIG. 7). Upper latching tab receiving apertures 126 (FIG. 6) are disposed in spaced-apart relation on the upper portion of front surface 122. Upper latching tab receiving apertures 126 have chamfered edges 127 to facilitate assembly of one-piece conductive connector shell 1 to insulating connector housing 100, as will hereinafter be disclosed in further detail.

Upper latching tab cavities 128 (FIG. 7 and 8) extend rearwardly through flange 120 from apertures 126 so as to open on back surface 124. Cavities 128 have internal shoulders 129, spaced away from apertures 126, for fixedly engaging the forwardly facing free ends 38 (FIG. 4) of upper latching tabs 30, as will hereinafter be disclosed in further detail.

Tubular projection receiving holes 130 (FIG. 6) are disposed in spaced-apart relation on front surface 122, below upper latching tab receiving apertures 126. Tubular projection receiving holes 130 extend rearwardly through flange 120 and have chamfered edges 131 to facilitate assembly of one-piece conductive connector shell 1 to insulating connector housing 100.

Grounding tab receiving apertures 135 (FIG. 6) are disposed in spaced-apart relation on front surface 122, below tubular projection receiving holes 130. Grounding tab receiving apertures 135 have chamfered edges 136 disposed about their periphery to facilitate assembly of the insulating connector housing 100 to the one-piece conductive connector shell 1.

Figure 8:
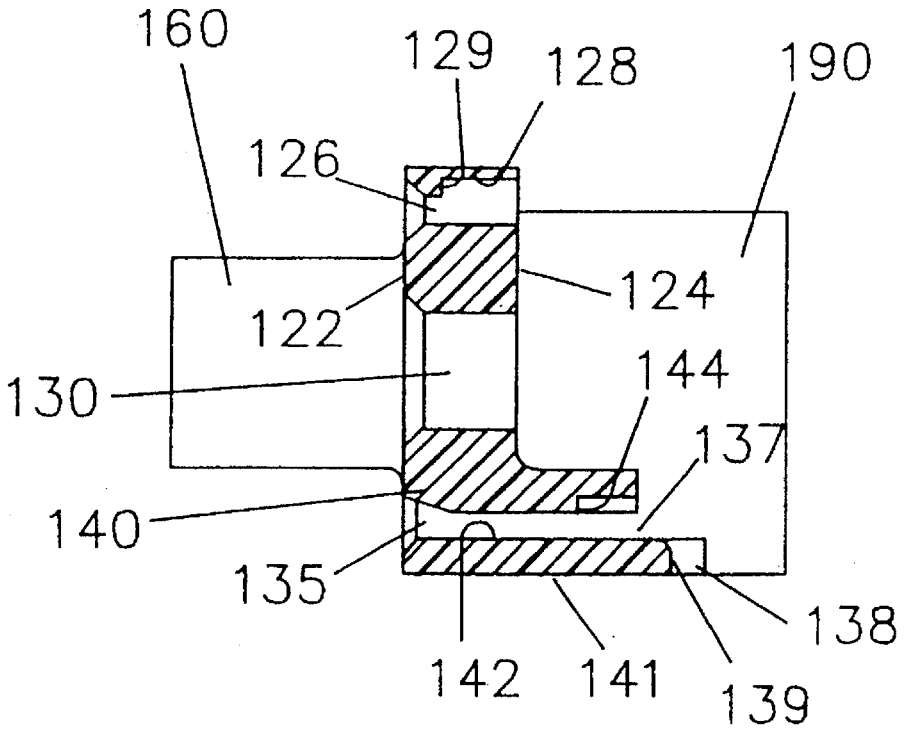
FIG. 8 is a cross-sectional view, as taken along line 8—8 of FIG. 6.
Figure 9:
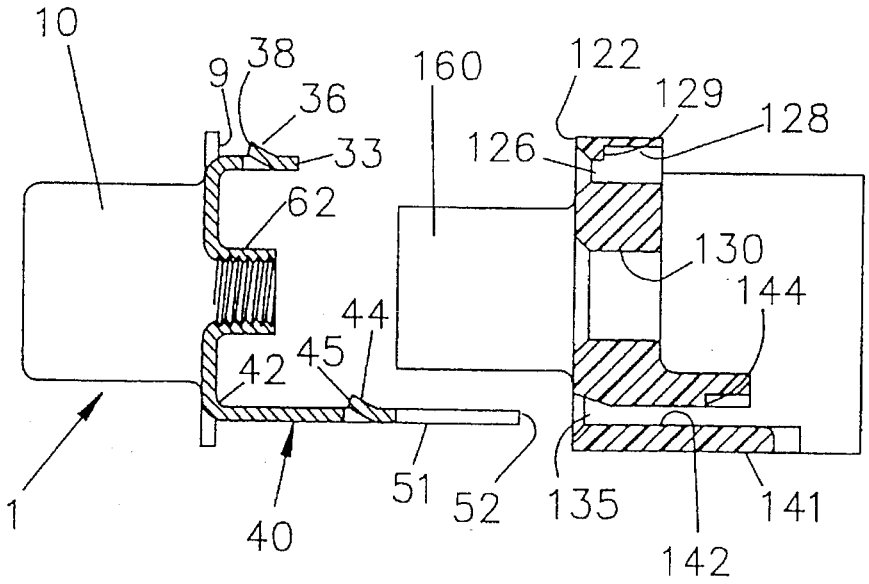
FIG. 9 is a side elevational view, partially in section, showing the one-piece conductive connector shell and the insulating connector housing absent electrical contacts in the housing just prior to assembly.
Figure 10:
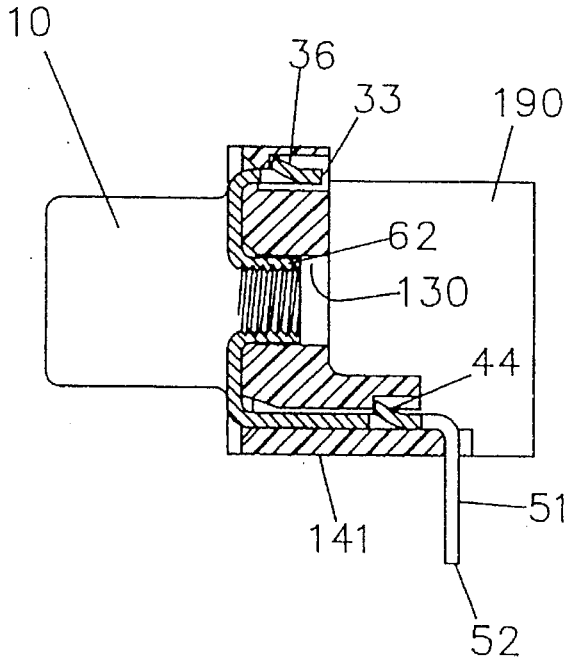
FIG. 10 is a cross-sectional view, as taken along line 10—10 of FIG. 1, showing the one-piece conductive connector shell fully assembled to the insulating connector housing absent electrical contacts in the housing.

Still referring to FIGS. 6, 7, and 8, insulating connector housing 100 further comprises a base portion 140 that extends rearwardly from the bottom portion of flange 120. Base portion 140 comprises a lower mounting face 141 (FIG. 8) that is adapted to sit evenly on a surface of a PCB. A pair of grounding tab retaining cavities 142 are disposed in spaced-apart relation within base portion 140. Grounding tab retaining cavities 142 extend rearwardly through base portion 140, from grounding tab receiving apertures 135 to an end aperture 137. A separating projection 138 (FIGS. 7 and 8) is centrally disposed in a tine-receiving slot 139 at the rear bottom edge of each grounding tab retaining cavity 142. Tine-receiving slots 139 are radiused at their forward end (FIGS. 8, 9, and 10) so that tines 51 may be bent into slot 139. In this way, tines 51 can project downwardly in a substantially perpendicular manner from base portion 140 upon final assembly of one-piece conductive connector shell 1 to insulating connector housing 100 (FIG. 10). Separating projection 138 further ensures that tines 51 are maintained in spaced-apart relation after the bending operation.

Each grounding tab retaining cavity 142 has an internal shoulder 144 (FIG. 8) spaced away from apertures 135 and 137. Internal shoulders 144 are similar to internal shoulders 129 disclosed above in connection with cavities 128. Internal shoulders 144 are adapted to fixedly engage free ends 45 (FIG. 9) of lower retaining latch 44.

A plurality of positioning portions 146 (FIG. 7) extend rearwardly from back surface 124 and are adapted to position electrical contacts in a predetermined pattern. The plurality of positioning portions 146 provide alignment and positioning for electrical contacts and facilitate mounting of the complete electrical connector onto a PCB.

D-shaped projection 160 (FIG. 8) extends forwardly from front surface 122 of flange 120. D-shaped projection 160 is adapted to fit tightly within annular D-shaped projection 10 of one-piece conductive connector shell 1. A mating face 162 (FIG. 6) is disposed at the distal end of D-shaped projection 160. Mating face 162 further includes a plurality of openings 164 adapted to expose the mating portions of the electrical contacts located therein. D-shaped projection 160 and mating face 162 are adapted for mating with a complementary connector during use (not shown).

Insulating connector housing 100 has a plurality of mutually-insulated cavities 180 (FIG. 7) for receiving electrical contacts. The plurality of cavities 180 communicate with mating face 162 via a plurality of openings 164. Hood 190 extends rearwardly from flange back surface 124 and is adapted to protect and insulate the electrical contacts.

Typically, insulating connector housing 100 further comprises a plurality of electrical contacts 200 (FIG. 1) that are well known in the art. Each electrical contact 200 comprises a PCB mating portion 206 that extends downwardly from insulating connector housing 100. PCB mating portion 206 is adapted to be soldered in plated-through holes (not shown) provided in the printed circuit board. The PCB mating portion 206 provides an electrical interconnection with traces on the PCB.

Now referring to FIGS. 9 and 10, the one-piece conductive connector shell 1 is assembled to insulating connector housing 100 as follows. Lower grounding tabs 40 are first bent back, approximately 90 degrees with respect to fastening wing 15, so as to extend rearwardly from lower edge 42. Next, one-piece conductive connector shell 1 is positioned in front of insulating connector housing 100 so that free ends 33 of upper latching tabs 30 are disposed opposite upper latching tab receiving apertures 126, as seen in FIG. 9. In this position, tips 52 of tines 51 are disposed opposite lower grounding tab receiving apertures 135. One-piece conductive connector shell 1 is then moved toward insulating connector housing 100 so that shell flange back surface 9 engages and completely shields housing flange front surface 122. As this occurs, upper retaining latches 36 are driven through upper retaining latch cavities 128 until forwardly facing free ends 38 slip behind and fixedly engage rearwardly facing internal shoulders 129. At the same time, lower retaining latches 44 are driven through grounding tab retaining cavities 142 until forwardly facing free ends 45 slip behind and fixedly engage rearwardly facing internal shoulders 144. Once flange back surface 9 has fully engaged flange front surface 122, tines 51 are bent downwardly approximately 90 degrees so as to be oriented substantially perpendicular to mounting face 141 (FIG. 10).

Since certain changes may be made in the above apparatus and method without departing from the scope of the invention herein involved, it is intended that all matter contained in the above description or shown in the accompanying drawings shall be interpreted in an illustrative and not in a limiting sense. For example, the one-piece conductive connector shell 1 could easily be adapted for use with a non-printed circuit board mounted connector or for various other shielded connectors that receive jackscrews.

What is claimed is:

1. A method for making a shielded electrical connector comprising the steps of:

(1) providing a one-piece conductive connector shell and an insulating connector housing, said one-piece shell comprising a front shell wall, a pair of upper tabs, and a pair of elongate lower tabs, said upper and lower tabs adapted to fasten said one-piece conductive connector shell to said insulating connector housing, all of said upper and lower tabs at least initially extending orthogonally rearwardly from said front wall and said insulating connector housing including front and back surfaces, a pair of upper tab-receiving cavities and a pair of lower tab-receiving cavities, each of said tab-receiving cavities extending orthogonally rearwardly from said front surface and including rearwardly facing internal shoulder portions adapted to fixedly engage corresponding portions of said upper and said lower tabs;

(2) positioning said one-piece shell in front of said front surface of said insulating connector housing so that said upper tabs are disposed opposite said upper tab-receiving cavities and so as to position said lower tabs opposite said grounding tab-receiving cavities;

(3) moving said one-piece conductive connector shell and said insulating connector housing toward one another until a back surface of said one-piece shell engages said insulating connector housing front surface and upper retaining latches on said upper tabs fixedly engage said internal shoulder portions of said upper tab-receiving cavities and lower retaining latches on said lower tabs fixedly engage said internal shoulder portions of said lower tab-receiving cavities; and (4) bending an end portion of each of said lower tabs substantially 90 degrees with respect to said tab-receiving cavities so as to be oriented substantially perpendicular thereto and extend from said housing to allow board-mounting of the connector to a circuit board by insertion of said end portions into the circuit board, while the upper tabs and remaining portions of the lower tabs are insulatively covered by the housing.

2. An electrical connector, comprising:

a one-piece electrically conductive shell and an insulative connector housing adapted to contain therein a plurality of electrical contacts, said one-piece shell including a front shell wall, a pair of upper tabs, and a pair of lower tabs, all of said upper and lower tabs at least initially extending orthogonally rearwardly from said front wall and including latching portions adapted to fasten said one-piece shell to said insulating connector housing, and said insulative housing including a pair of upper tab-receiving cavities and a pair of lower tab-receiving cavities all extending orthogonally rearwardly from a front face of said insulting housing at least to rearwardly facing shoulders cooperable with said latching portions of said upper and lower tabs of said one-piece shell upon full insertion into said cavities to retain said shell to said housing, ends of said lower tabs are adjacent intermediate lower tab portions and are located rearwardly beyond said rearwardly facing shoulders of said lower tab-receiving cavities upon full insertion of said lower tabs thereinto, and said ends include board-retention sections defined thereon enabling mounting of the connector onto a circuit board upon said lower tab ends being bent downwardly upon full insertion of said lower tabs into said lower tab-receiving cavities to allow said board-retention sections to be inserted into a board, whereby said one-piece shell provides for board-mounting of the connector while all of said upper tabs and said intermediate lower tab portions are insulatively covered upon fastening of said one-piece shell to said insulative housing.

3. The connector as set forth in claim 2 wherein said one-piece shell includes a pair of jackscrew-receiving apertures each being a tubular projection extending rearwardly from said front wall and adapted to receive a respective jackscrew of a mating connector thereinto, and said housing including a pair of tubular projection receiving holes disposed in spaced-apart relation on said front face.

4. The connector as set forth in claim 2 wherein said insulative housing includes a hood extending forwardly from said front face around exposed contact sections of said plurality of electrical contacts, and said one-piece shell includes a correspondingly shaped projection extending forwardly from said front wall thereof to be disposed around said hood for shielding thereof.

* * * * *